US005489090A

United States Patent [19]

Leger

[11] Patent Number: 5,489,090

[45] Date of Patent: Feb. 6, 1996

[54] CLAMPING AND SHAPING TOOL

[75] Inventor: Josef Leger, Menden, Germany

[73] Assignee: Produkt & Markt Gesellschaft für Produktmanagement Handel und Vertrieb mbH, Dortmund, Germany

[21] Appl. No.: 244,091

[22] PCT Filed: Sep. 14, 1993

[86] PCT No.: PCT/EP93/02484

§ 371 Date: May 16, 1994

§ 102(e) Date: May 16, 1994

[87] PCT Pub. No.: WO94/07660

PCT Pub. Date: Apr. 14, 1994

[30] Foreign Application Priority Data

Oct. 6, 1992 [DE] Germany ..... 42 33 492.6

[51] Int. Cl.[6] ..... B25B 1/10

[52] U.S. Cl. ..... 269/244; 269/158; 269/284; 269/283

[58] Field of Search ..... 72/481; 83/699.11; 269/244, 158, 159, 221, 279, 280, 283, 284; 279/124

[56] References Cited

U.S. PATENT DOCUMENTS

| | | | |
|---|---|---|---|
| 530,733 | 12/1894 | Tower | 269/283 |
| 3,403,901 | 10/1968 | Servadio | 269/284 |
| 4,813,310 | 3/1989 | Moynihan | 269/284 |
| 5,015,003 | 5/1991 | Ramunas | 269/284 |
| 5,042,352 | 8/1991 | Lux | 72/481 |
| 5,078,586 | 1/1992 | Holzschuh | 72/481 |

*Primary Examiner*—Robert C. Watson
*Attorney, Agent, or Firm*—Anderson Kill Olick & Oshinsky

[57] ABSTRACT

A multi-functional tool with clamping- and shaping jaws (14) is to be created, which is quickly adaptable to the respective different application uses and which can provide if need be not only high clamping- rather also high shaping forces.

This is achieved by guiding the tool jaws (14) by means of guide elements (15) aligned essentially in feed or advance direction in the basic member (2) or in the trolley (3), that the tool jaws (14) are retained by means of a centered clamping element (16, 17, 19) in their working position and that, in addition to a spindle drive (5–7) for moving the trolley relative to the basic member (2), at least one additional mechanical, pneumatic, hydraulic and/or electromotive feed element (12) actuatable by a pedal (**12*a***) is provided.

9 Claims, 2 Drawing Sheets

CLAMPING AND SHAPING TOOL

BACKGROUND OF THE INVENTION

The invention is directed to a clamping- and deformation or shaping tool with tool jaws fastened so as to be replaceable at a stationary basic member on the one hand and on a mobile trolley on the other hand with the jaws being movable against each other by means of a spindle drive similar to a bench vise.

Clamping tools having a spindle drive and being manually actuatable, so-called bench vises, are known in different embodiments. Herein it is also known, to design the clamping jaws depending upon the application purpose differently and replaceably, in which connection we merely refer to the DE-C-34 30 814 or DE-A-41 37 927 by way of an example. The problem of designing clamping jaws so as to be replaceable is comparatively old so that very old solutions are known, for instance the DE-C-28 49 92 or DE-C-34 14 34.

In deformation or shaping tools it is necessary to generate high deformation forces, which frequently cannot be supplied by a vise which is manually actuated through a spindle drive, so that it is known to use mechanical step-up gearing as a drive also in order to generate high clamping forces, as is for instance described in the FR-C-1 054 956 or DE-A-2 058 806.

The need often arises to use a tool permitting all of the following tasks to be performed on work benches for accomplishing the most differing processing problems, as for instance bending of different shapes, riveting, embossing, crimping, stamping, cutting flat-, round- and profiled material as well as steel pipe, non-ferrous metal, plastics material, textile or similar materials.

This necessitates to equip this workbench with mechanical power actuation, to integrate auxiliary means such as adjustable stops and straight edges into same and to dispose in such a bench quick-change tools appropriate for the task in this bench vise.

Tools for these tasks usually consist of two parts, these can be in the form of plates as cutting- or embossing tools and similar, on the one hand, and as counter parts or anvils for this, on the other hand. These plates need to be aligned with respect to one another in a positionally accurate way.

In known solutions which also include the DE-C-32 11 521 of the applicants or the U.S. Pat. No. 1,799,526 and the U.S. Pat. No. 2,489,731, answers for only partial regions are offered, meaning either an adaptation of the clamping jaw to different task definitions is possible or the application of higher clamping forces. Contrary to that it is the task of the invention to create a multi-functional tool, which is respectively quickly adaptable to different usage purposes and which if necessary can provide not only high clamping-, but rather also high deformation forces.

SUMMARY OF THE INVENTION

This task is solved in the invention with a clamping- and deformation tool of the type described above by providing guidance elements in the basic member or trolley for aligning the tool jaws, with the guidance elements being essentially aligned in feed direction, and with the tool jaws being retained in their working position by a central clamping element, and by providing, in addition to the spindle drive, at least one additional pedal-activated drive. By guiding the tool jaws in the basic member or the trolley an exact positioning is made possible, which is necessary for performing accurate work. Simple handling and quick adaptation to different types of work are feasible by providing quick-change devices for the tool jaws, wherein the application of higher clamping or deformation forces is enabled by the additional feed- or advance-element.

The L-shaped design of the tool jaws with appropriate guides in the other tool elements enables a precise alignment of the tool jaws. The design of the quick change device with a pull head and pull pin subjected to spring action makes it possible to provide here depending upon the prestress a manual actuation by means of a push key, wherein a very compact construction is possible for instance by means of an internal bore in the push key and the thereby assured possibility of actuating the prestressing nut.

Apart from other possibilities of generating a deformation force a foot operated linkage is available, wherein the transfer of the application plane of the actuating linkage into a plane in front of the stationary tool jaw again results in a very compact and simple type of construction.

BRIEF DESCRIPTION OF THE DRAWINGS

The invention is described with particularly in the following with the help of examples in the drawing. It is shown in.

DETAILED DESCRIPTION OF THE PREFERRED EMBODIMENT

Figure 1:
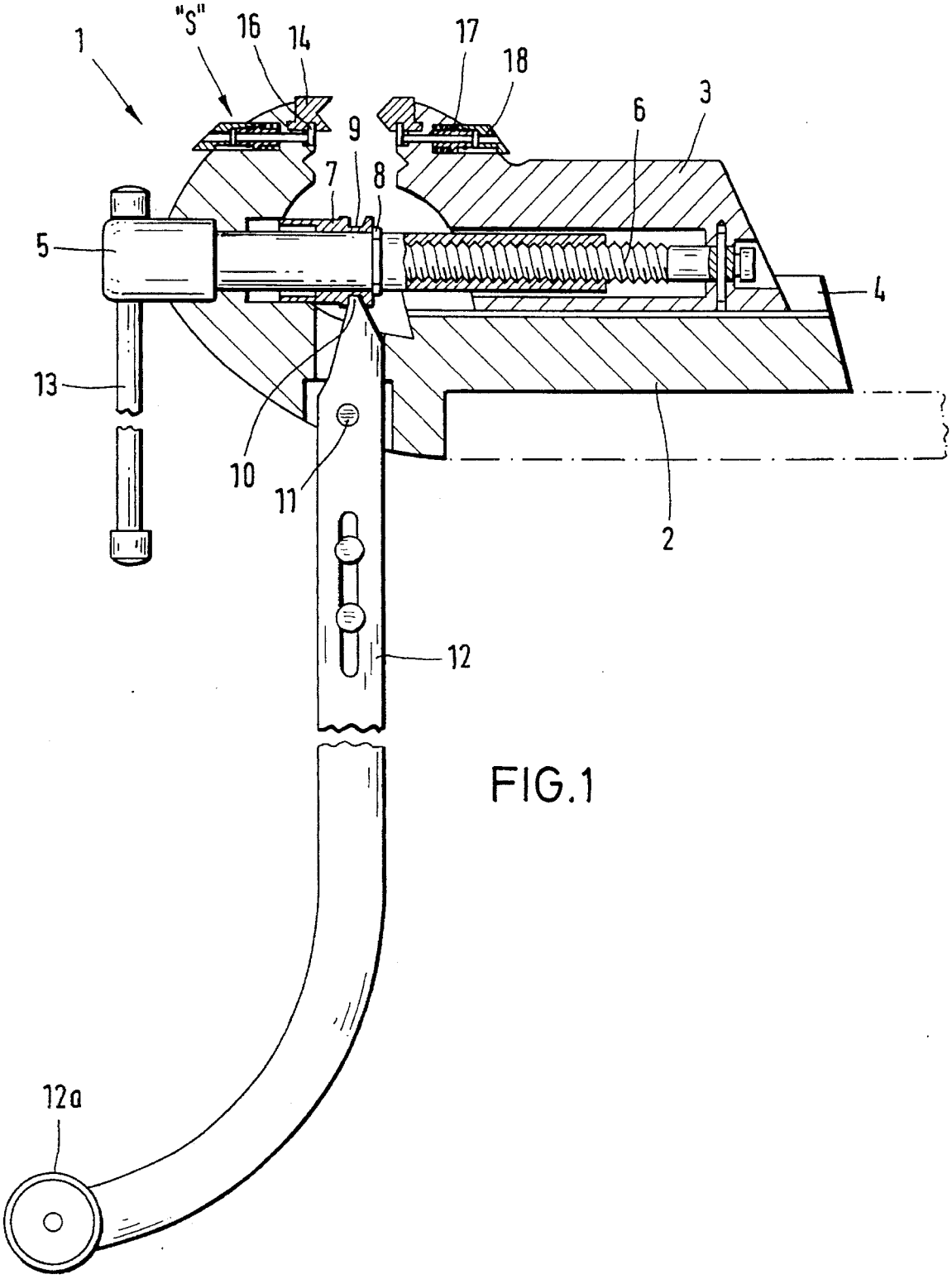
FIG. 1 a simplified illustration as a longitudinal section through the tool in the invention, FIG. 2 a magnified illustration of a portion of the tool jaw quick change device as well as in FIG. 3 a partial view upon the attachment region of the tool jaws.
Figure 2:
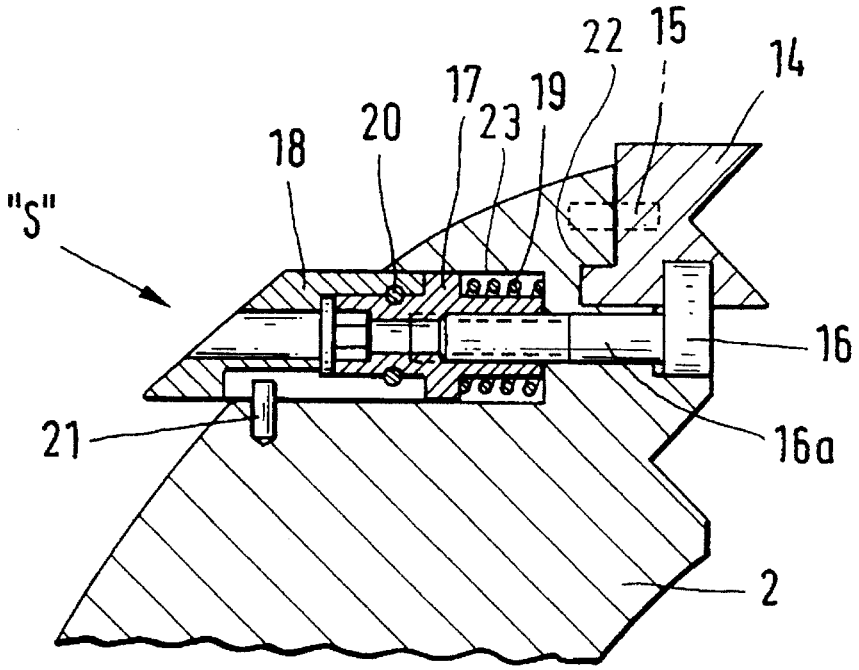
Figure 3:
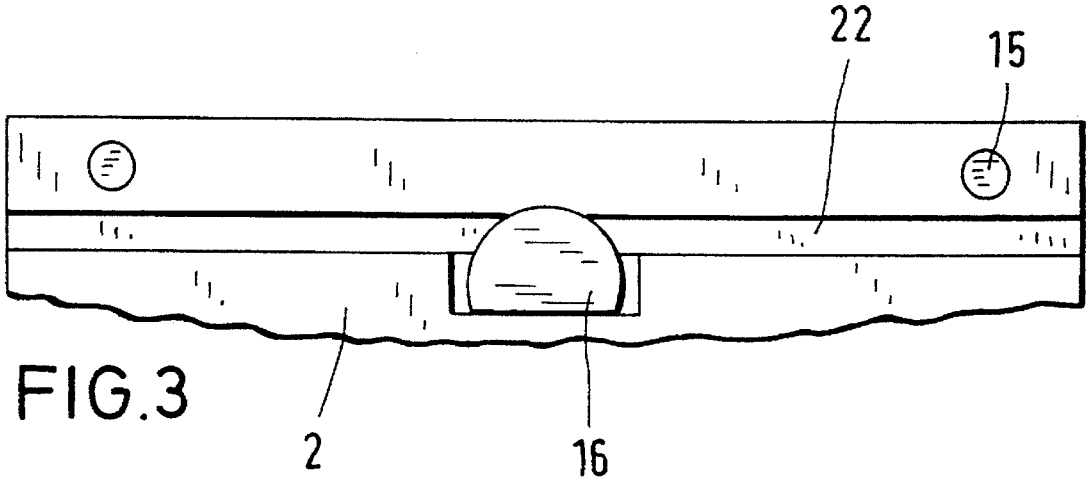

The tool generally designated with the numeral 1 is fastened with its basic member 2, wherein a trolley is movable in guide rails 4, to a work bench shown in dash-dotted lines and not designated in more detail in this case.

The movement of the trolley 3 is performed by a feed or advance element, which in the example shown consists of a spindle sleeve 5 supported in the basic member 2 and a spindle 6 fastened in the trolley, which spindle engages into the spindle sleeve 5. The front portion of the spindle sleeve 5 is stepped and is supported so as to be axially displaceable in a stepped bore in the basic member. A bushing 7 is disposed rotatably on the spindle sleeve 5, which bushing sits on the one side at a collar of the spindle sleeve 5 and on the other side is fixed in axial direction by a lock washer 8.

A bar linkage 12 pivotable in the basic member 2 around a bolt 11 engages with a cam 10 into an annular groove 9 in the bushing 7. The bar linkage 12 is height-adjustable and is actuated by the pedal 12*a*.

The bushing 7 with the spindle sleeve 5 as well as the spindle 6 and with it the trolley 3 is longitudinally movable in the region of the spacing between the step of the spindle sleeve 5 and the planar side of the bushing 7 facing this step by operating the bar linkage 12. The trolley 3 however can also be moved by rotating the spindle sleeve 5 on the spindle 6. Herein the bushing 7 together with the spindle sleeve 5 abuts at the basic member 2. The hand lever or clamp handle 13 for exerting the rotary motion is disposed in the foremost portion of the spindle sleeve 5.

Tool jaws 14 are fastened so as to be replaceable in the top region of the basic member 2 and the trolley 3. The tool jaws 14 are configured to be L-shaped respectively at the side facing the basic member 2 or the trolley 3 and engage in a positively locking manner into corresponding recesses 22 in the basic member 2 or the trolley 3. The tool jaws 14 are positioned by means of fixed pins 15 respectively in the basic member 2 and the trolley 3, which pins engage into bores of the tool jaws 14, so as to prevent sidewise displacement.

A quick change arrangement "S", comprising a pull-head 16 with a pull pin 16*a*, a nut 17, a push key 18, a spring 19, a snap ring 20 and a pin 21, is disposed in a stepped bore 23 in the base member 2 and trolley 3 respectively.

The pull pin 16*a* consists of a threaded portion in the head 16, wherein the head 16 is flattened and rests with its flattening upon a recess 22 of the tool plate receptacle in the basic member 2 or the trolley 3.

The nut 17 is rotatable in the stepped bore 23 on the threaded portion of the pull pin 16*a*. The spring 19 is disposed between an annularly-shaped attachment of the nut 17 and the annular surface of the stepped bore 23. Upon engagement of the head 16 of the pull pin 16*a* into the groove of the respective tool jaw 14, this jaw is pulled by the spring 19 into a positively locking L-shaped receptacle.

A rotatable connection is established by a snap ring 20 disposed in annular grooves upon an extension of the nut 17 and a bore in the push key 18. The push key 18 is secured against turning by a pin 21 which engages into an elongated hole of the push pin 18.

Tools such as a screw driver or an internal hexagonal wrench can be brought into connection with a slot or an internal hexagon in the nut 17 through a longitudinal bore in the push key 18. The nut 17 can thus, if need be, be tightly bolted against the bore extension to the pull pin 16*a* whereby a fixed connection of the respective tool jaw 14 with the basic member 2 or the trolley 3 can be established through the connection of the hook of the pull pin 16 and groove in the tool jaw 14. Upon disconnecting this connection only the nut 17 must be loosened and then moved longitudinally by means of the push key 18 whereby the tool jaw 14 is released.

I claim:

1. A clamping and shaping tool comprising:

a set of pairs of replaceable tool jaws, with each pair of replaceable tool jaws having a predetermined shape;

a stationary basic member and a mobile trolley, displaceable relative to said basic member, for supporting tool jaws of a respective pair of tool jaws;

means provided in each of said stationary basic member and said mobile trolley and aligned in a displacement direction of said mobile trolley for aligning the tool jaws of the respective pair of tool jaws;

quick release means provided in each of said stationary basic member and said mobile trolley for retaining the tool jaws in an operational position thereof;

a spindle drive for displacing said mobile trolley toward and away from said stationary basic member; and foot-activated pedal displacement means for applying increased clamping and deformation forces to said mobile trolley.

2. A clamping and shaping tool according to claim 1, wherein the tool jaws are substantially L-shaped, wherein said stationary basic member and said mobile trolley have each complimentary means for receiving respective L-shaped tool jaws in a positively locking manner, wherein said aligning means comprises pin means for engaging corresponding recesses in a respective tool jaw, and wherein said quick release means comprises a hook-shaped pull member engaging into an engagement groove in the respective tool jaws and a spring for biasing said hook-shaped pull member into a position in which the respective tool jaws are positively lockingly received in said stationary basic member and said movable trolley.

3. A clamping and shaping tool according to claim 2, wherein said hook-shaped pull member has a head engaging into said engagement groove in the respective tool jaw, and a pin, said quick release means further comprising a push key connected with said pin and projecting beyond an external contour of said stationary basic member and said mobile trolley, respectively.

4. A clamping and shaping tool according to claim 3, wherein said quick release means further comprises a nut engageable with said spring for prestressing said spring, said pin extending through said nut.

5. A clamping and shaping tool according to claim 4, wherein said push key cooperates with said nut and has an internal bore for actuating said nut.

6. A clamping and shaping tool according to claim 5, wherein said quick release means further comprises a pin for securing said push key against rotation, and said nut is provided with one of a screwdriver slot and an internal hexagon.

7. A clamping and shaping tool according to claim 5, wherein said nut is provided with one of a screwdriver slot and an internal hexagon.

8. A clamping and shaping tool according to claim 1, wherein said pedal displacement means includes a bar linkage cooperating with said mobile trolley for displacing the same with the increased force.

9. A clamping and shaping tool according to claim 8, further comprising a spindle bushing connected to said mobile trolley for displacement therewith and having an annular groove, said stationary basic member having an opening trough which said bar linkage extends, and said bar linkage having at an end thereof remote from a foot-operated pedal one of an engagement cam and a fork engaging into said annular groove of said spindle bushing.

* * * * *